United States Patent [19]

Renner

[11] 4,199,667

[45] Apr. 22, 1980

[54] MICROPHONE HAVING MEANS FOR SUPPRESSING STRUCTURE-BORNE SOUNDS

[75] Inventor: Heinz Renner, Vienna, Austria

[73] Assignee: AKG Akustische u. Kino-Gerate Gesellschaft m.b.H., Austria

[21] Appl. No.: 908,725

[22] Filed: May 23, 1978

[30] Foreign Application Priority Data

May 26, 1977 [AT] Austria ..... 3764/77

[51] Int. Cl.[2] ..... H04R 1/02; H04R 9/08; H04R 19/04

[52] U.S. Cl. ..... 179/121 R; 179/179

[58] Field of Search ..... 179/121 R, 121 D, 138, 179/179, 180

[56] References Cited

U.S. PATENT DOCUMENTS 3,240,883 3/1966 Seeler ..... 179/138

FOREIGN PATENT DOCUMENTS 1160157 7/1969 United Kingdom ..... 179/179

*Primary Examiner*—George G. Stellar

*Attorney, Agent, or Firm*—McGlew and Tuttle

[57] ABSTRACT

The arrangement for suppressing structure-borne sounds in microphones comprises an electroacoustic transducer which substantially includes a housing part, a diaphragm firmly connected to said housing and receiving the sound, and a corresponding transducer system and in which the electroacoustic conversion of the signal is based on the relative motion between the diaphragm and the transducer system, the natural resonance as well as the logarithmic decrement of said transducer system being at least approximately equal to the natural resonance and the logarithmic decrement of the diaphragm. Microphone types include moving voice coil, electrostatic, and ribbon.

11 Claims, 4 Drawing Figures

MICROPHONE HAVING MEANS FOR SUPPRESSING STRUCTURE-BORNE SOUNDS

BACKGROUND OF THE INVENTION

1. Field of the Invention

The invention relates in general to microphones and in particular to a new and useful arrangement for suppressing structure-borne sounds in microphones which are caused by mechanical impacts or vibrations and may lead to corresponding noise signals at the microphone output. Substantially, the invention is concerned with microphones comprising a diaphragm receiving the intelligence sound and fixed to a part which does not directly serve the purpose of converting the signal, and a transducer system corresponding to the diaphragm and necessary for converting the signal.

2. Description of the Prior Art

To abate structure-borne noise caused by mechanical vibrations of a microphone due, for example, to a touch or collision with another object, or to movements of the microphone cable or to the friction of the microphone housing on the user's clothing (Lavalier microphones), substantially two possibilities are given which may be applied individually or in combination;

One possibility is to mount the microphone capsule in the microphone housing resiliently, which arrangement is used frequently. Thorough tests have shown, however, that no satisfactory solution can thereby be obtained. That is, a satisfactory damping is attained only above the natural resonance frequency of the mounting means of the resiliently mounted microphone capsule. Therefore, it would be desirable for an effective damping of these disturbances occurring mostly in the low frequencies, to reduce the natural resonance frequency of the mounting or suspension means as far as possible, preferably below the lowermost frequency to be transmitted.

This, however, is considerably difficult with the modern high-quality microphones having a response range extending from about 30 Hz to 20 kHz, since the lower a mounting resonance frequency is provided, the lesser becomes the mechanical stability of the arrangement, so that tumbling motions and excursions in excess of the capsule in the microphone housing can hardly be prevented, which may lead to mechanical damages of the arrangement. In arrangements of the prior art, the mounting resonance ranges approximately from 50 Hz to 300 Hz, which is still within the usual frequency band to be transmitted. It is therefore obvious that a satisfactory solution of the problem, namely of preventing over a large band the occurrence of disturbing voltages caused by vibrations of the microphone, cannot be obtained with the simple resilient suspension of a microphone capsule from a housing.

The other possibility of abating such disturbing voltages is the compensation method. In the application of this method, a second transmitter system is coupled to the microphone capsule mounted in a housing, which system is inactive relative to the intelligence sound and of such design and arrangement that at the occurrence of mechanical vibrations or shocks, it delivers electric signals which are identical with those delivered by the system provided for converting the intelligence sound. The two outputs are connected to each other in electrical opposition, so that the signals produced by the mechanical vibrations compensate each other.

The transmitter needed for producing the compensating current may be designed, for example, quite symmetrically to the intelligence sound receiver and combined therewith with a screening against the intelligence sound, in a common arrangement which may, in addition, be resiliently mounted in a microphone housing. It is also possible, however, to use for the compensation a transmitter system having one part, namely the part necessary for converting the structure-borne sound into electric signals, rigidly secured to the electroacoustic transducer receiving the intelligence sound and resiliently mounted in the microphone housing, and having its other part rigidly connected to the microphone housing. The electric signal produced by the movements relative to each other of the two parts of the compensating transducer system is delivered in phase opposition to the transducer converting the intelligence sound.

The disadvantage of the prior art compensation arrangement is that they require a second transducer, and perhaps a careful tuning of the two systems to each other over a larger frequency range. In general, the compensation method makes it possible to obtain a satisfactory damping of the disturbing noise, but it must not be overlooked that as compared to the conventional, non-compensated microphones, the transmission factor is reduced to about one half. This drawback may be partly remedied only by improving the efficiency of the sound conversion, which, however, is possible only within certain limits and requires additional expenses.

SUMMARY OF THE INVENTION

The invention is directed to an arrangement avoiding the disadvantages of the known compensation methods but producing at least the same effect as the prior art arrangements and requiring no second electroacoustic transducer which would furnish the compensating voltage.

To this end and in accordance with the invention, the compensation of spurious electric signals occurring due to mechanical shocks or vibrations of the microphone at the output thereof is effected by firmly connecting the sound receiving diaphragm to a part which does not serve the purpose of converting the signal or which even may be a component part of the transducer system serving the purpose of this electroacoustic conversion, and by connecting the transducer system or the remaining part thereof, in a manner pemitting oscillation, by means of at least one resilient element, to the part carrying the diaphragm, and, at the same time, by providing that the natural resonances and logarithmic decrements of this oscillatory system and of the diaphragm are equal or substantially equal to each other.

The "logarithmic decrement", as is well known, is the decay factor which, in damped oscillations, is represented by the natural logarithm of the ratio of two consecutive amplitudes in the same direction.

The invention starts from the idea that it is preferable to compensate the spurious electric signals directly at the location of their occurrence, namely in the transducer receiving the intelligence sound. This makes a second transducer and its screening against the outer sound field needed in the prior art arrangements, unnecessary. Further, due to the omission of a compensating transducer, the same sensitivity in the conversion of the intelligence sound into electric signals is obtained as in conventional microphones having no noise compensation. In addition, for the same reasons, the inventive arrangement can be embodied in a smaller size than the known arrangements.

Another advantage of the invention is that in the inventive design, a relatively stiff resilient mounting means can be used between the part supporting the diaphragm and the transducer system, so that there is no risk of mechanically damaging the transducer system at strong impacts.

Particularly advantageous is the use of the inventive arrangement in transducers of the electrodynmaic type, irrespective of whether a moving-coil microphone or a velocity microphone is concerned, and the transducer system necessary for converting the intelligence sound may be embodied by the magnetic system itself or by a part thereof.

Accordingly, it is an object of the invention to provide a microphone comprising a tubular transducer housing with a diaphragm having a rim secured to the housing and including magnetic system including a yoke disposed adjacent the diaphragm with a permanent magnet having a pole plate mounted on the yoke, wherein the diaphragm carries a moving coil which is disposed between the yoke and the pole plate and which further includes resilient means supporting said magnetic system on said housing so that the resonance as well as the logarithmic decrement of the oscillatory system is at least approximately equal to the natural resonance in the logarithmic decrement of the diaphragm.

A further object of the invention is to provide a microphone which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
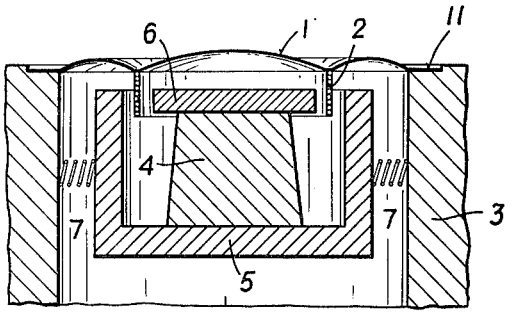
FIG. 1 is a diagrammatical sectional view of an electrodynamic microphone comprising the inventive arrangement.

Referring to the drawings in particular, the invention embodied therein comprises a microphone having an arrangement for suppressing structure-borne sound. The electrodynamic microphone diagrammatically shown in FIG. 1 comprises a diaphragm 1 having its rim 11 affixed, for example, glued, to the front surface of a tubular or box-like transducer housing 3. Diaphragm 1 carries a moving coil 2 projecting into the air gap of a magnetic system which comprises, for example, a permanent magnet 4, a cup-shaped yoke 5, and a pole plate 6. In conventional moving-coil microphones, the magnetic system is firmly connected to the transducer housing. This is no longer the case with the inventive arrangement. The sole connection between the transducer housing and the magnetic system is at least one resilient element 7 permitting a relative motion between the magnetic system and the housing 3 supporting the diaphragm 1. While in the diagrammatical showing, the resilient elements 7 are indicated by zig-zag lines, in practice, only elements made of a resilient material are used.

Figure 2:
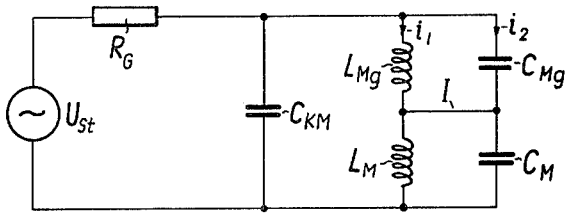
FIG. 2 is the equivalent circuit diagram.

The function of the inventive arrangement may be best explained with reference to FIG. 2 showing the equivalent circuit. It is assumed that even a microphone provided with the inventive compensation of the structure borne sound is advantageously resiliently suspended from an outer housing, since in cooperation with the resilient mounting, the damping of the spurious electric signals caused by mechanical vibration or shocks is improved, particularly at higher frequencies.

In the equivalent circuit diagram (FIG. 2) the following designations are used:

$R_G$ the outer housing $C_{KM}$ The springiness (mechanical capacitance) of the resilient mounting between the capsule and the outer housing $L_{mg}$, $C_{mg}$ mass of the magnetic system, and springiness between the magnetic system and the diaphragm seat, respectively, $L_M$, $C_M$ mass and springiness of the diaphragm, respectively.

The outer disturbing forces acting on the microphone are represented in the equivalent diagram by the voltage source $U_{st}$. The forces produce partial currents $i_1$ and $i_2$ in $L_{mg}$-$L_m$ and in $C_{mg}$-$C_m$. By suitably dimensioning, primarily, $C_{Mg}$, an equal magnitude of the two partial currents and the absence of a differential current I can be obtained.

In practice, this means that with an adequate dimensioning, upon the occurrence of disturbing forces, both the diaphragm and the resiliently mounted magnetic system will execute oscillatory motions over a large frequency range, which motions are equal to each other as to phase position, fidelity, and amplitude, wherefore no spurious electric signals will be produced in the moving coil. Advantageously, the mounting resonance of the magnetic system will be chosen equal to the resonance of the diaphragm, or at least in the vicinity thereof.

It is also possible, however, to make the mounting means of the magnetic system of a material having a suitably high internal friction, or to provide other measures for preventing markedly excessive amplitudes in the resonance range of the magnetic system. Since usually, the resonance of the diaphragm will be damped already for acoustic reasons, a more favorable compensation behavior, with a broader band, can be obtained in such a case if different values are provided for the mounting resonance and the diaphragm resonance.

Figure 3:
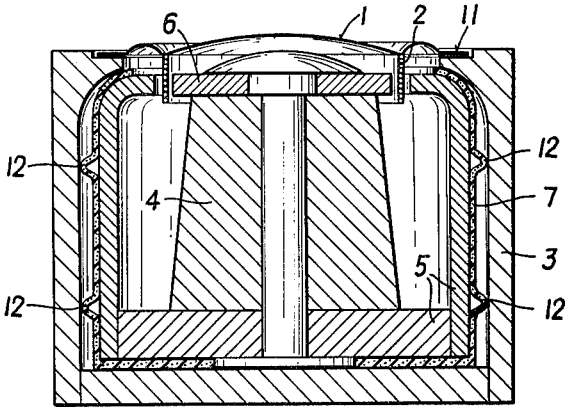
FIG. 3 is a partial sectional view of a moving-coil microphone comprising the inventive arrangement, as constructed in practice.

A construction realized in practice of a moving-coil microphone comprising the inventive arrangement is shown in FIG. 3. The reference numerals used therein correspond to the numerals of FIG. 1. It is evident that the inventive idea can be applied very easily. What is needed is only a resilient intermediate layer 7 between the transducer housing 3 and the magnetic system including parts 4, 5 and 6, which intermediate layer may be of rubber or a plastic having similar properties. Laterally projecting elevations 12 prevent the magnetic system from executing disturbing lateral motions. Otherwise, elevations 12 permit the motion of the magnetic system in the direction of oscillation of the moving coil, since in such a case they act in the manner of a tilting bearing for the magnetic system.

In the embodiment described in the foregoing, it has been assumed that the magnetic system as a whole is resiliently mounted. It is also possible, however, to mount resiliently only parts thereof which are located in the effective range of the moving coil. This possibility is given, for example, for pole plate 6. With such a design, noise signals upon mechanical vibrations of the microphone are not produced because due to the resilient support of pole plate 6, there is no motion of the moving coil relative to the magnetic flux. Such a relative motion, however, would be the condition for inducing a voltage in coil 2.

Figure 4:
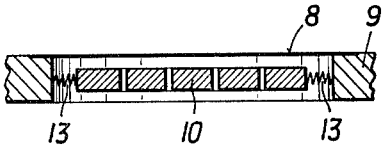
FIG. 4 shows the application of the invention to an electrostatic microphone.

The inventive arrangement is not limited to electrodynamic moving-coil microphones; it may be used with success also in velocity microphones or electrostatic microphones, as shown in the example of FIG. 4.

The ring 9 supporting a diaphragm 8 also supports, by means of resilient elements 13, a counterelectrode 10 or backplate which, as well as diaphragm 8, is a substantial component part needed for the conversion of the sound into electric signals. Instead of a rigid counterelectrode 10, an electrode of an elastic, preferably, conducting material may be used, so that, with an appropriate design of the marginal zone of such an electrode, the resilient elements 13 can be omitted. The counterelectrode may be provided in such a shape, for example, that by varying the thickness in the direction of the rim, an effective resilient mounting is obtained without disturbingly affecting the function of the transducer.

While specific embodiments of the invention have been shown and described in detail to illustrate the application of the principles of the invention, it will be understood that the invention may be embodied otherwise without departing from such principles.

What is claimed is:

1. An arrangement for suppressing structure-borne sounds in microphones comprising an electroacoustic transducer which substantially includes a housing part, a diaphragm firmly connected to said housing and receiving the sound, and a corresponding transducer system and in which the electroacoustic conversion of the signal is based on the relative motion between said diaphragm and said transducer system, the natural resonance as well as the logarithmic decrement of said transducer system being at least approximately equal to the natural resonance and the logarithmic decrement of the diaphragm.

2. An arrangement according to claim 1, wherein said electroacoustic transducer is of the moving coil type including a moving coil connected to said diaphragm, and a magnetic system, said magnetic system being resiliently mounted on said housing.

3. An arrangement according to claim 1 wherein said transducer system is embodied by a counterelectrode of an electrostatic transducer.

4. An arrangement according to claim 2 wherein said counterelectrode is made of a material which is electrically conducting and resilient per se, said resilient means being united to said diaphragm.

5. An arrangement according to claim 4, wherein said counterelectrode is affixed to said transducer housing opposite the diaphragm by said resilient means.

6. An arrangement according to claim 5, including resiliently mounting said transducer in said microphone housing.

7. An arrangement for suppressing structure-borne sounds in a microphone, said arrangement comprising:

a housing;

a diaphragm firmly connected to said housing and receiving said structure-borne sounds from said housing, said diaphragm also being movable in response to other sounds that are to control generation of corresponding electric signals;

an electroacoustic transducer structure; and resilient support means attached to said housing and receiving said structure-borne sounds therefrom, said resilient support means supporting said electroacoustic transducer structure in predetermined spaced relationship with respect to said diaphragm, whereby relative movement between said diaphragm and said electroacoustic transducer structure generates electric signals, said resilient support means transmitting said structure-borne sounds selectively to said electroacoustic transducer structure to produce substantially equal movements of said diaphragm and said electroacoustic transducer structure in response to said structure-borne sounds, and said relative movement between said electroacoustic transducer structure and said diaphragm being primarily due to said other sounds.

8. An arrangement according to claim 7, wherein said transducer structure comprises a counterelectrode.

9. An arrangement according to claim 7, wherein:

said electroacoustic transducer structure comprises a magnetic system comprising a pole and a yoke with an end portion close to said pole and oppositely permanently magnetically polarized with respect to said pole to establish a magnetic field therebetween; and said diaphragm comprises a coil that moves in response to movement of said diaphragm and is located in said magnetic field to generate said electric signal in response to said relative movement.

10. An arrangement according to claim 9, wherein said resilient means includes a covering of resilient material around said yoke and supporting said magnetic system on said housing.

11. An arrangement according to claim 10, wherein said resilient material comprises a rubber material engaging around the surface of said yoke and having at least one projection extending outwardly therefrom bearing against said housing.

* * * * *